United States Patent [19]

White, Jr.

[11] Patent Number: 4,596,167

[45] Date of Patent: Jun. 24, 1986

[54] TORQUE MULTIPLIER WRENCH SET

[76] Inventor: Roy White, Jr., 50 Evergreen St., Lowell, Mass. 01852

[21] Appl. No.: 634,686

[22] Filed: Jul. 26, 1984

[51] Int. Cl.[4] ..... B25G 1/04

[52] U.S. Cl. ..... 81/177.2

[58] Field of Search ..... 81/177 A

[56] References Cited

U.S. PATENT DOCUMENTS

| | | | |
|---|---|---|---|
| 1,713,527 | 5/1929 | Furst | 81/177 A X |
| 1,746,452 | 2/1930 | Wesson | 81/177 A |
| 2,743,642 | 5/1956 | Randall | 81/177 A |
| 3,376,768 | 4/1968 | Fortunato | 81/177 A |

*Primary Examiner*—James G. Smith

*Attorney, Agent, or Firm*—Pearson & Pearson

[57] ABSTRACT

A torque multiplier consists of a wrench or a set of wrenches, to be used with a torque wrench to increase the capacity of a torque wrench by specific ratios, each having an elongated, non-extensible, straight shank with a laterally extended drive stud at one end and a laterally disposed stud socket at the other end. The studs of each wrench can be made to fit the sockets of each other wrench in the set, so that they can be mounted end to end in a straight line to multiply the leverage, torque foot pounds, or mechanical advantage of a single wrench of the set. The studs, or sockets, may be square or hexagonal and may be of the ratchet type.

4 Claims, 3 Drawing Figures

TORQUE MULTIPLIER WRENCH SET

BACKGROUND OF THE INVENTION

It has heretofore been proposed to increase the torque of a wrench, by providing means for the handle to move further out on the shank for increased leverage as in U.S. Pat. No. 2,520,652 to Pfauser of Aug. 29, 1950 and U.S. Pat. No. 2,869,410 to Prichard of Jan. 20, 1959.

It has also been proposed to provide extensible torque rods in which the handle moves longitudinally on the shank for increased length, a drive stud projects longitudinally from one end and a drive socket, or nut, has a longitudinal central axis at the other end. Exemplary of such structures are those disclosed in U.S. Pat. No. 3,306,639 to Lyon of Feb. 28, 1967, U.S. Pat. No. 4,317,393 to Graffam of Mar. 2, 1982, and U.S. Pat. No. 4,376,397 to Newby, et al of Mar. 15, 1983. These devices are intended to reach into difficult places where a wrench could not be fitted and turned, and to extend outwardly so that their outer end can be turned by a handle at right angles to the rod in the manner of a crank.

Angularly adjustable handles on wrenches are disclosed in U.S. Pat. No. 2,570,706 to Peluse of Oct. 9, 1951 and U.S. Pat. No. 4,334,445 to Timewell of June 15, 1982, but they are not connectable end to end.

SUMMARY OF THE INVENTION

As far as I am aware, there is not available in the trade or taught in the patent art, a torque multiplier, other than those mentioned above which have extensible handles, and which will enable the doubling or tripling of applied torque by adding one or more straight line, interfitting wrenches, end to end until the desired length is achieved to apply the desired foot pounds of torque.

In this invention, a set of identical wrenches is provided, each wrench having a straight, one piece, tapered, shank, with a straight, central, longitudinal axis, a drive stud projecting laterally therefrom at one end of the shank and a drive socket apertured laterally thereto at the opposite end. The axis of the stud and the axis of the socket is normal to the central longitudinal axis of the straight shank and each stud drivingly fits the socket in the next successive wrench, so that the wrenches can be assembled into a composite, straight, elongated assembly capable of exerting multiples of the torque of a single wrench.

Either the stud or the socket of each wrench may have a ratchet mechanism of a type well known in the trade and the preferred lengths of the wrenches of the set are six inches, twelve inches, eighteen inches, or twenty-four inches from the center of the stud to the center of the socket of each wrench.

DESCRIPTION OF A PREFERRED EMBODIMENT

Figure 1:
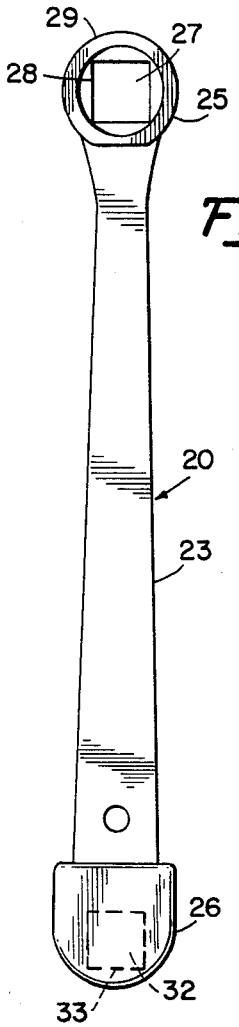
FIG. 1 is a top plan view of one of the wrenches of the set of torque multiplier wrenches of my invention.

As shown in the drawing, each wrench 20, of the set 21, of torque multiplier wrenches such as 20 and 22 includes a one-piece, non-extensible, straight, shank 23, having a central longitudinal axis 24, and opposite terminal ends 25 and 26.

A stud socket 27 is provided at terminal end 25 having polygonal, inner, side walls 28, defining a square or hexagon, a cylindrical outer wall 29, and a central axis 31, which is normal to the central longitudinal axis 24, of shank 23.

A stud 32 projects laterally from the other end 26 of the shank 23, stud 32 having polygonal outer side walls 33, defining a square or hexagon which closely and slidably fits within the socket 27 of the other wrenches of the set. Stud 32 has a central longitudinal axis 34, which is normal to central longitudinal axis 24, of shank 23, and parallel to axis 24, of socket 27.

Figure 2:
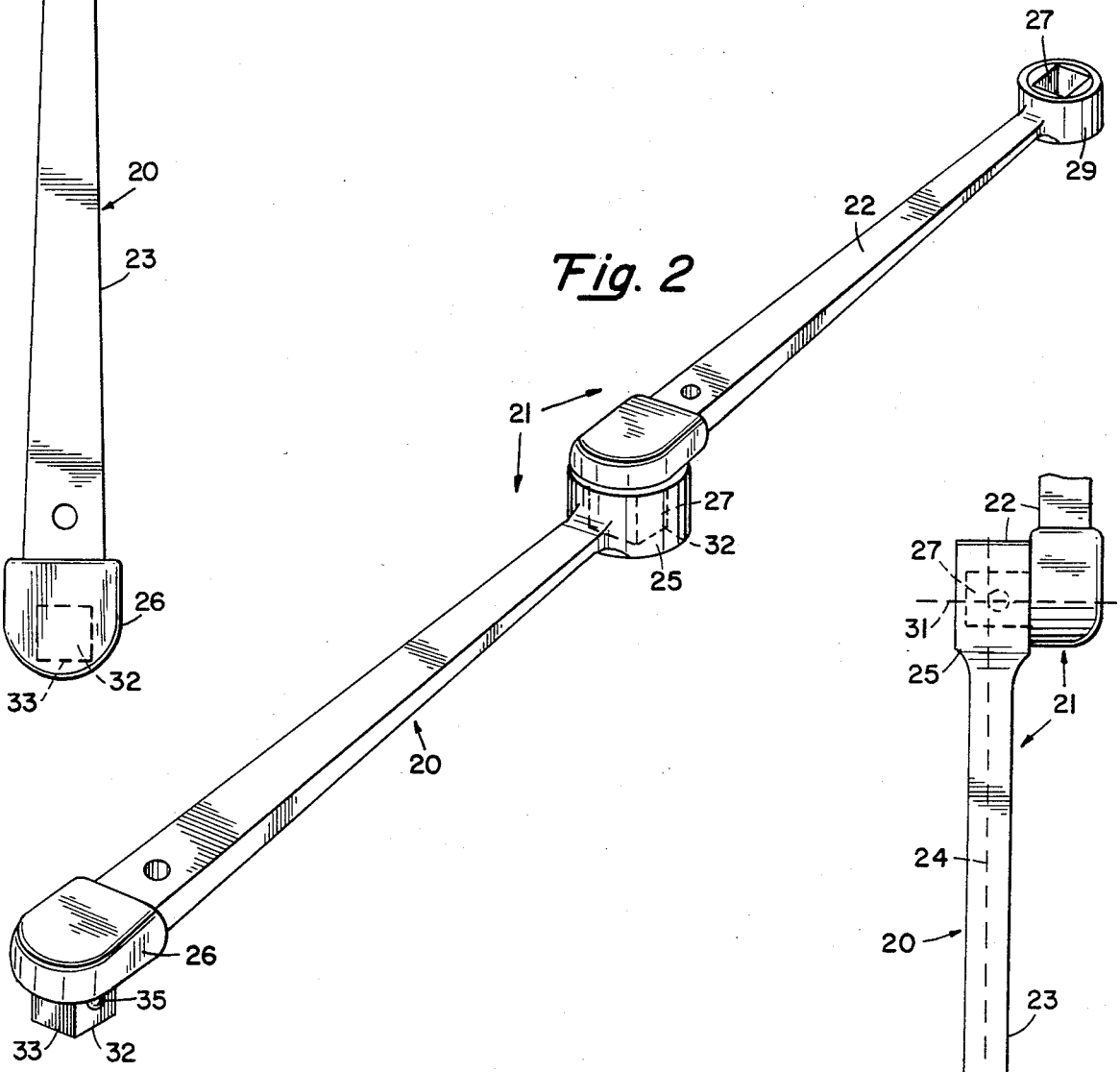
FIG. 2 is a perspective view showing two identical wrenches of the set, extending in a straight line, end to end with the stud of one firmly seated in the socket of the other.
Figure 3:
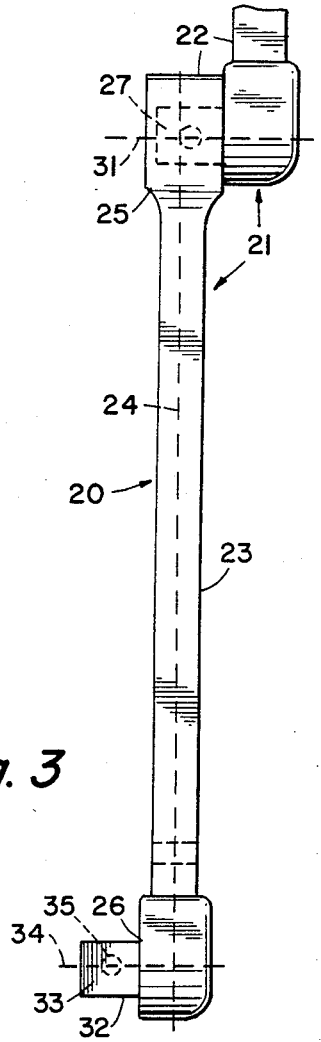
FIG. 3 is a side elevation of the torque multiplier wrench set shown in FIG. 2.

As shown in FIGS. 2 and 3, each wrench 20, 22, and any other identical wrenches of the set 21, can be mounted end to end in straight line relationship. Thus, if wrench 20 will apply a predetermined torque, leverage, or mechanical advantage to a part to be turned, the addition of a second wrench 22, with its stud 26 firmly seated in the stud socket 27, of the preceding wrench 20 will double the torque and the addition of a third such wrench will triple the torque.

While not shown, the studs 32 can be replaceable in the head 26, or they can be double headed, or of the ratchet type. Similarly, the sockets 27 can be of the ratchet type and can be replaceable to match the replaceable studs.

Preferably, a spring pressed button 35 is provided on each stud to assist in seating the same in the sockets.

In use, it may be necessary to turn the bolts on the head of a Diesel engine, which may be specified to require a torque of 400 foot pounds. It is unlikely that an extensible handle wrench would reach that torque. However, the use of one or more of the torque wrenches of this invention, in straight line extension of each other end to end, will multiply the torque of a torque wrench to an amount which will lighten a bolt by exertion of four hundred foot pounds.

It would be understood that, for example, if each torque multiplier wrench of the set is twelve inches long, each additional twelve inch wrench of the set will double the torque of the previous wrench, on a 2 to 1 ratio.

The dimensions of the studs, sockets and shanks of the torque multiplier wrenches disclosed herein may be varied as desired to achieve the torque multiple desired or to achieve desired torque ratios.

I claim:

1. A torque multiplier wrench set comprising:

a plurality of identical torque transmitting wrenches;

each said wrench having an elongated, one-piece straight non-extensible shank with a central, longitudinal axis, and opposite terminal ends;

a drive stud on the front face of the said shank and projecting laterally from one said terminal end, said stud having generally square outer sidewalls and a central axis normal to the central longitudinal axis of said shank;

a stud socket at the other terminal end of said shank, on the rear face of said shank, said socket having a central axis normal to the central longitudinal axis of said shank and generally square inner sidewalls;

the drive stud of each wrench of said set slidably, and drivingly, fitting the stud socket of the preceding wrench, in said set, in end to end straight line relationship, to multiply the torque, leverage and mechanical advantage applied to the drive stud of the first wrench in said set;

the drive stud having a spring pressed button to assist in seating the stud in the socket.

2. A torque multiplier wrench set as specified in claim 1 wherein:

each wrench of said set includes ratchet mechanism at said one terminal end of the shank thereof operably connected to said drive stud.

3. A torque multiplier wrench set as specified in claim 1 wherein:

said other terminal end of each wrench of said set is cylindrical in outer configuration and the elongated straight, shank of each said wrench is tapered from a relatively wide portion at said one end to a relatively narrow portion at said other end.

4. A torque multiplier wrench set comprising:

an elongated one piece straight shank having a laterally extending stud rocket with generally square inner sidewalls on the rear face of the said shank of one end of said shank;

a laterally extending drive stud with generally square outer sidewalls on the front face of the said shank at the other end of said shank for fitting into a stud socket at the opposite end of another wrench of the set and;

a plurality of wrenches are combined end to end with an identical wrench of said plurality of wrenches into an elongated, straight line with the generally square laterally extending drive stud of one wrench fitting into the the stud socket of the next wrench to form a straight lever at the required length to exert a desired torque which multiplies the leverage of torque foot pounds or mechanical advantage of a single wrench of the set.

* * * * *

UNITED STATES PATENT OFFICE
CERTIFICATE OF CORRECTION

Patent No. 4,596,167 Dated June 24, 1986

Inventor(s) Roy White, Jr.

It is certified that error appears in the above-identified patent and that said Letters Patent are hereby corrected as shown below:

On the title page,

Item /76/ address should be "50 Evergreen Road", not "50 Evergreen St."

Col. 2, line 45, should read "tighten" not "lighten"

Signed and Sealed this

Twenty-first Day of October, 1986

[SEAL]

*Attest:*

DONALD J. QUIGG

*Attesting Officer* *Commissioner of Patents and Trademarks*